US005522102A

United States Patent [19]

Vayda

[11] Patent Number: 5,522,102

[45] Date of Patent: Jun. 4, 1996

[54] WALL BED APPARATUS

[76] Inventor: George T. Vayda, 405 Church St., Hertford, N.C. 27944

[21] Appl. No.: 353,220

[22] Filed: Dec. 1, 1994

[51] Int. Cl.[6] ..... A47C 17/38

[52] U.S. Cl. ..... 5/133; 5/135; 5/159.1

[58] Field of Search ..... 5/2.1, 133, 134, 5/135, 136, 159.1, 162

[56] References Cited

U.S. PATENT DOCUMENTS

| | | | |
|---|---|---|---|
| 307,013 | 10/1884 | Carleton | 5/134 |
| 402,239 | 4/1889 | Graham | 5/134 |
| 457,796 | 8/1891 | Sextro | 5/134 |
| 464,387 | 12/1891 | Peace | 5/134 |
| 496,915 | 5/1893 | Smith | 5/134 |
| 830,141 | 9/1906 | Eastman | 5/134 |
| 997,284 | 7/1911 | Fuller | 5/134 |
| 1,088,970 | 3/1914 | Crouch | 5/134 |
| 1,094,526 | 4/1914 | Butterworth | 5/133 |
| 1,337,580 | 4/1920 | Ball | 5/134 |
| 2,689,355 | 9/1954 | De Frank | 5/108 |

FOREIGN PATENT DOCUMENTS

| | | | |
|---|---|---|---|
| 706030 | 3/1931 | France | 5/134 |
| 39850 | 12/1931 | France | 5/134 |
| 241932 | 12/1911 | Germany | 5/135 |

*Primary Examiner*—Michael J. Milano
*Attorney, Agent, or Firm*—Henderson & Sturm

[57] ABSTRACT

A wall bed apparatus (10) including a stand alone bed unit (11) including a bed frame (21) equipped with a pair of rocker panels (50) which support the bed frame (21) and associated mattress (100) in a vertically upright position and an enclosure unit (12) which partially surrounds the lower portion of the bed frame (21) in the vertical orientation and assists in maintaining the bed frame (21) and mattress (100) in the upright position.

12 Claims, 4 Drawing Sheets

WALL BED APPARATUS

TECHNICAL FIELD

The present invention relates to the field of wall beds in general, and in particular to a new free-standing wall bed apparatus and its associated enclosures.

BACKGROUND ART

As can be seen by reference to the following U.S. Pat. Nos. 3,965,498; 4,694,518; 4,370,766; and 5,033,134; the prior art is replete with myriad and diverse wall bed or "Murphy" bed style apparatus.

While all of the aforementioned prior art constructions are more than adequate for the basic purpose and function for which they have been specifically designed, these patented structures are uniformly deficient in a number of very noticeable respects in that they are unduly heavy and structurally complex; they are expensive to build, purchase and repair; and they almost always require some sort of permanent or semi-permanent attachment to either a wall or floor surface which both restricts their portability and/or causes the ownership of the device under certain circumstances to pass onto another individual such as a landlord by virtue of the physical attachment of the device to a house or apartment.

As a consequence of the foregoing situation, there has existed a longstanding need among a rather substantial number of individuals for a relatively inexpensive, lightweight, free-standing wall bed apparatus that is portable, easy to use and which also includes a multi-function enclosure that may be employed both with and without the primary bed unit; and, the provision of such a construction is a stated objective of the present invention.

DISCLOSURE OF INVENTION

Briefly stated, the wall bed apparatus that forms the basis of the present invention comprises a free-standing bed unit and an enclosure unit which not only assists in maintaining the bed unit in its vertical stored position, but which also serves as a combined bed linen storage facility and nightstand.

As will be explained in greater detail further on in the specification, the bed unit includes a pair of rocker panel elements which facilitate the movement of the bed unit between a vertically stored and a horizontally deployed mode; wherein, the sides of the bed frame member are equipped with a plurality of foldable panels and support legs.

In addition, the enclosure unit is designed to partially surround the bed unit when the bed unit is deployed in its storage position; and, the enclosure unit is also physically detachable from the bed unit to serve as a nightstand when the bed unit is operatively deployed.

BRIEF DESCRIPTION OF THE DRAWINGS

These and other attributes of the invention will become apparent upon a detailed study of the following description of the best mode for carrying out the invention, particularly when reviewed in conjunction with the drawings, wherein.

BEST MODE FOR CARRYING OUT THE INVENTION

Figure 1:
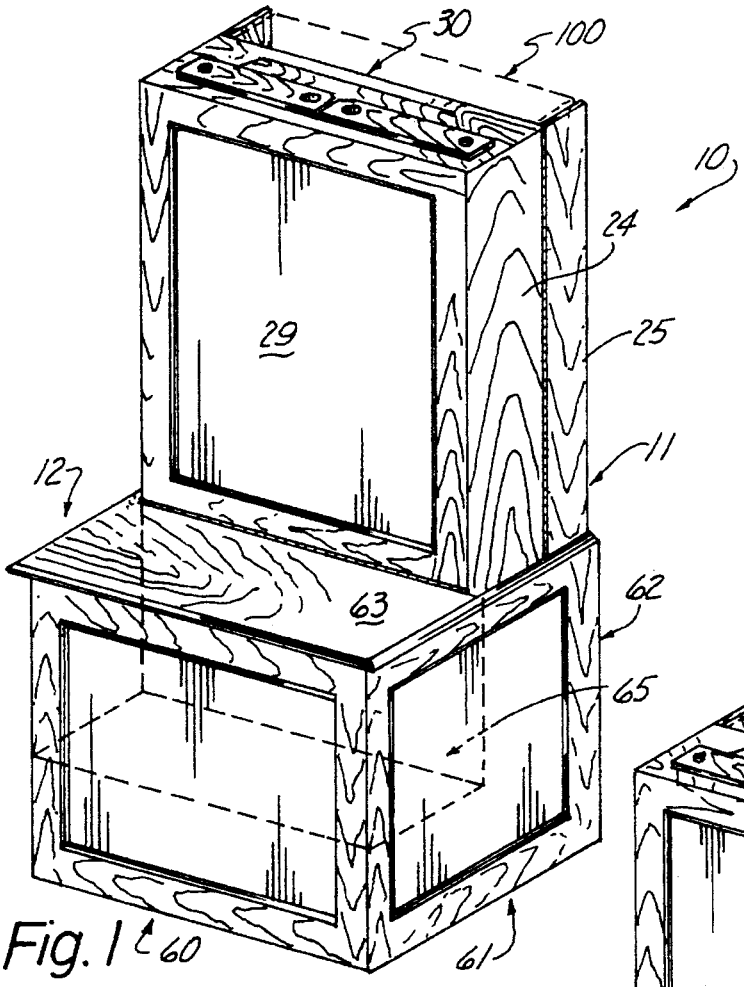
FIG. 1 is a perspective view of the highboy version of the preferred embodiment of the wall bed apparatus that forms the basis of the present invention.

As can be seen by reference to the drawings, and in particular to FIG. 1, the wall bed apparatus that forms the basis of the present invention is designated generally by the reference numeral (10). The wall bed apparatus (10) comprises a bed unit (11) and an enclosure unit (12). These units will now be described in seriatim fashion.

Figure 7:
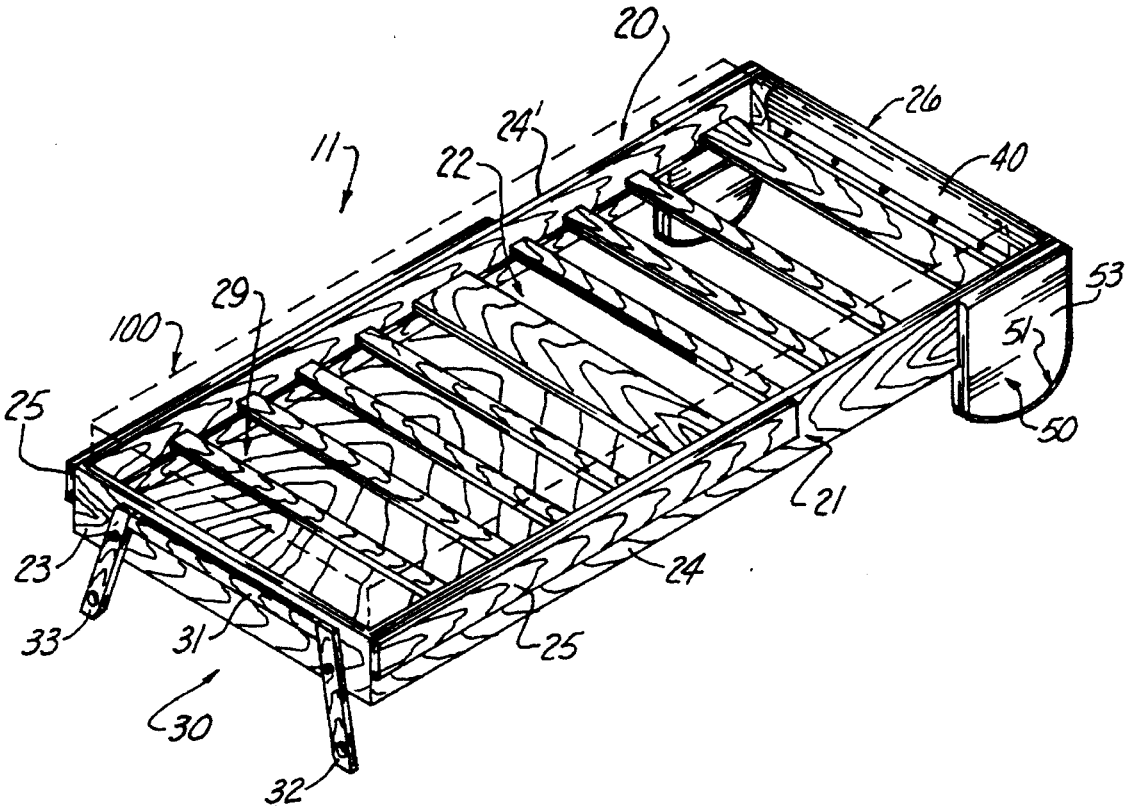
FIG. 7 is an isolated perspective view of the bed unit in the horizontal disposition.

As can best be seen by reference to FIG. 7, the bed unit (11) comprises in general, a bed member designated generally as (20) wherein the bed member (20) includes a generally open rectangular bed frame (21) having a conventional slat arrangement (22) for supporting a mattress (100) shown in phantom.

Figure 6:
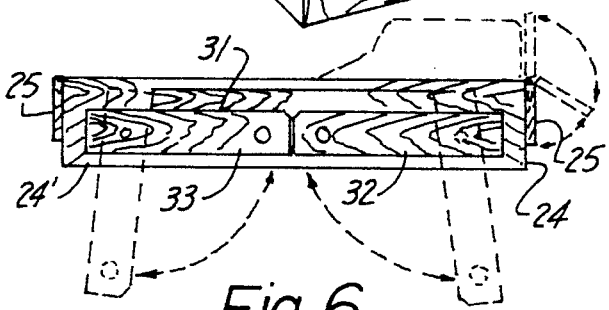
FIG. 6 is an end view of the bed unit.
Figure 8:
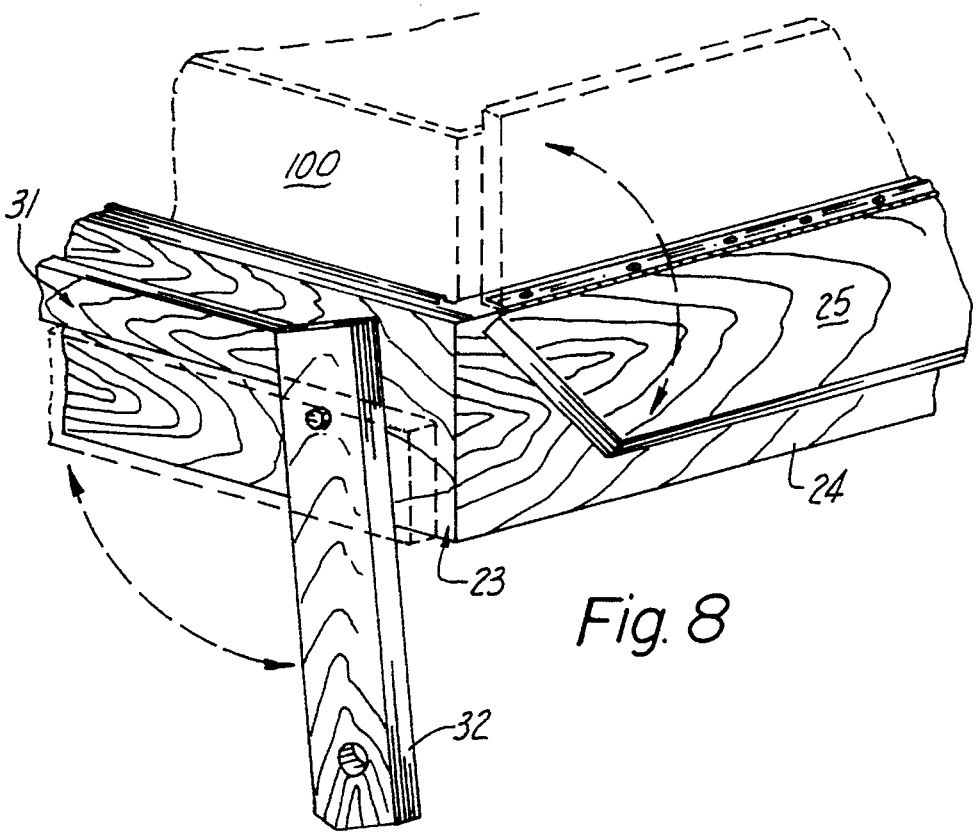
FIG. 8 is an isolated detail view of an outer corner of the bed unit.

As shown in FIGS. 6 through 8, a first end (23) of the bed frame is provided with a collapsible leg assembly (30) which includes an upper generally elongated bumper element (31) having slanted ends rigidly secured to the first end (23), and a pair of support legs (32), (33) pivotally secured to the first end (23) at a location spaced outwardly from and below the lower portion of the bumper element (31), wherein the support legs (32), (33) may be pivoted from a storage position in abutment with the bottom portion of the bumper element (31), as shown in FIG. 6, to the deployed position of FIGS. 7 and 8, wherein the upper ends of the support legs (32) (33) are abutting the slanted ends of the bumper element (31 ).

Still referring to FIGS. 6 through 8, it can be seen that both sides (24) (24') of the bed frame (21) are provided with elongated hinged panel elements (25) which extend rearwardly a substantial distance along the upper portion of each side (24), (24') of the bed frame (21) for reasons that will be explained presently.

Figure 5:
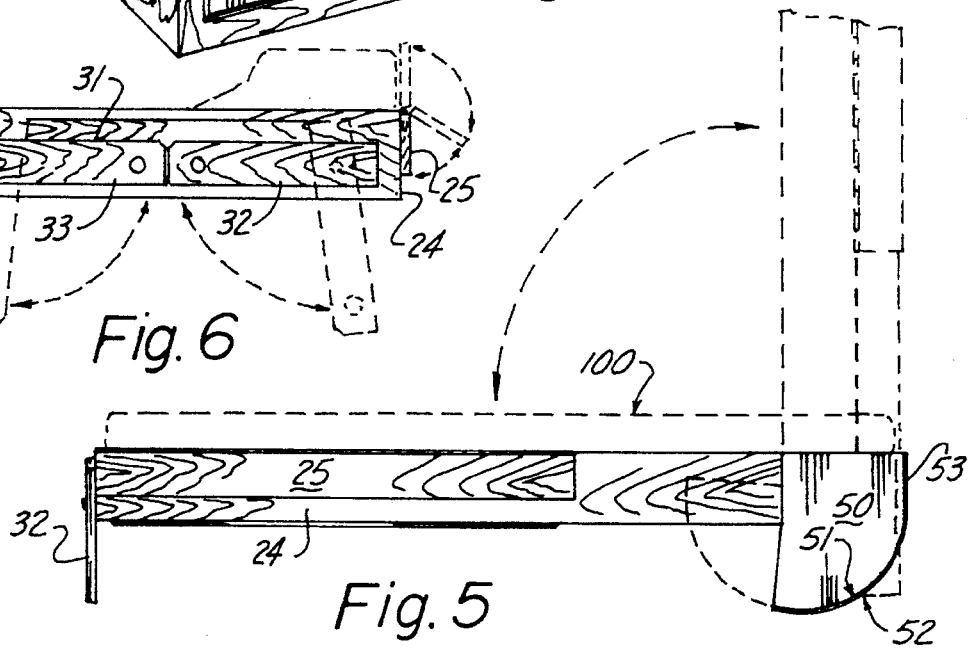
FIG. 5 is an isolated side view of the bed unit in the horizontal orientation.
Figure 9:
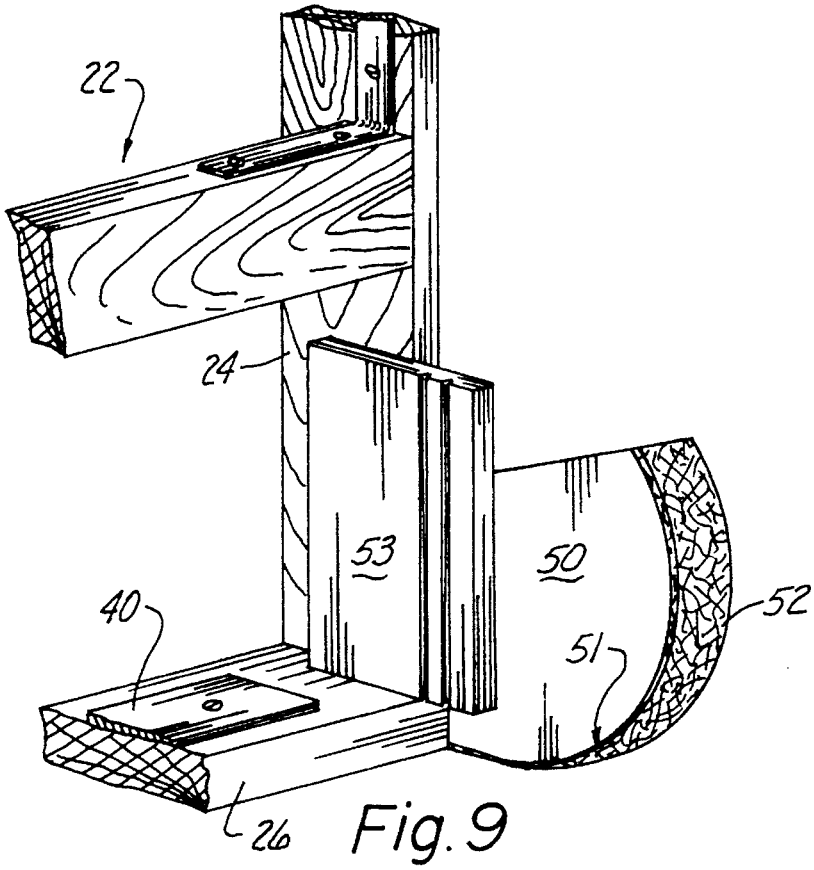
FIG. 9 is an isolated detail view of an inner corner of the bed unit.

As can best be seen by reference to FIGS. 5, 7 and 9, the second of the bed frame (21) end (26) is provided with a counterweight (40) and a pair of enlarged contoured rocker panels (50) having a 95° arcuate segment (51) and a flat segment (53). The outer periphery of the rocker panels (50) are provided with a protective covering (52) to prevent the rocker panels (50) from marring or scratching the floor surface that the wall bed apparatus (1) rests upon and wherein the flat segment (53) will support the bed frame (31) in a vertically upright stand alone position.

Figure 4:
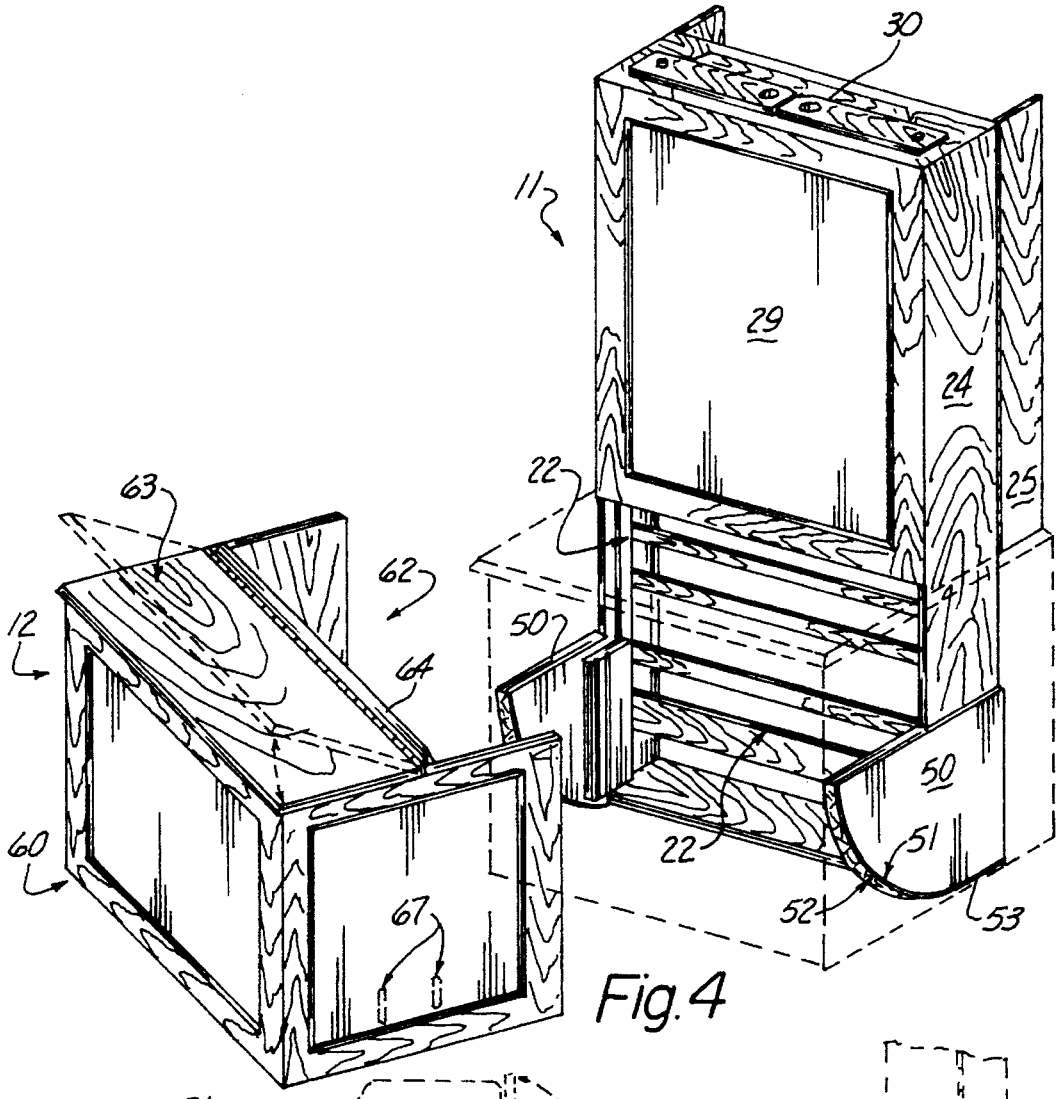
FIG. 4 is an exploded perspective view of the highboy version of the invention.

As shown in FIG. 9, the rocker panels (50) are secured to both sides (24), (24') and the second end (26) of the bed frame (21), and is further provided with a reinforcing cleat (53) to stiffen the apparatus (10) during the transition movement of the bed unit (11) between the storage mode of FIG. 4 to the operative mode of FIG. 5.

Figure 2:
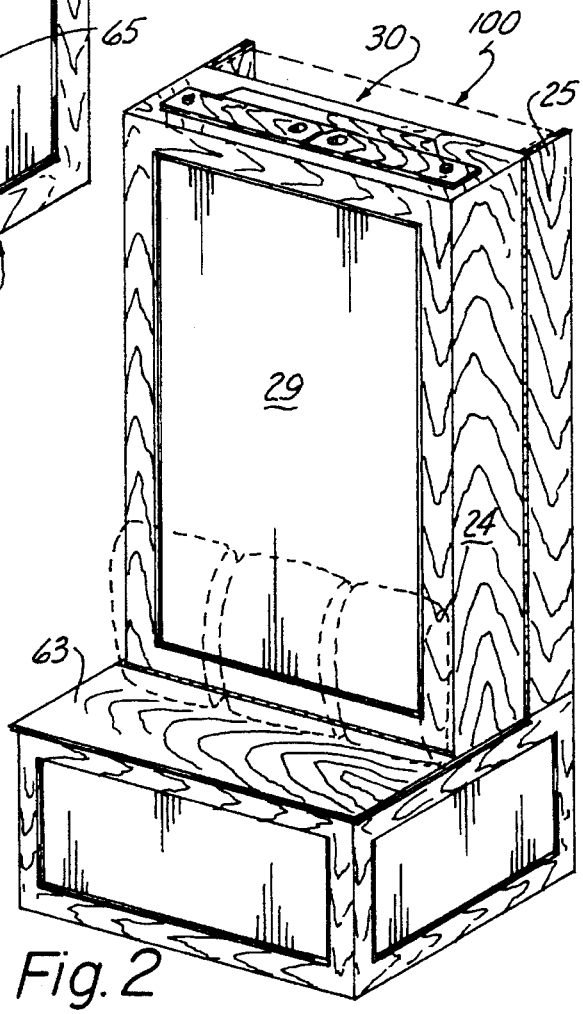
FIG. 2 is a perspective view of the lowboy version of the preferred embodiment.
Figure 3:
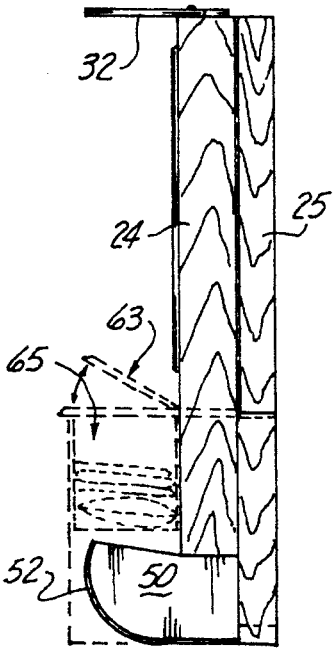
FIG. 3 is an isolated side view of the highboy version of bed unit in a vertical orientation.

Turning now to FIGS. 1, 2, and 4, it can be seen that the enclosure unit (12) comprises in general a three sided enclosure member (60) having an open bottom (61), an open back (62), and a hinged half-top lid (63). In addition, as shown in phantom in FIGS. 1 and 3, the enclosure unit (12) is further provided with an optional internal compartment (65). The access to the compartment (65) is controlled by the hinged lid (63).

As can also be appreciated by reference to FIGS. 1, 4, and 7, the bed frame (21) is further provided with a bottom panel (29) having a contoured face, which conforms to the stylized appearance of the enclosure unit (12) such that the wall bed apparatus (10) has the appearance of a conventional piece of furniture, such as the highboy of FIG. 1 or the lowboy of FIG. 2.

Referring once more to FIG. 4, it can be seen that the sides of the enclosure unit (12) overlays the sides (24), (24') of the bed frame (21) while the hinged lid (63) of the enclosure unit (12) is positioned adjacent to the bottom portion of the bottom panel (29) of the bed member (20) and is further provided with a raised bead (64). The enclosure unit (12) serves to stabilize the bed unit (11) when the bed unit (11) is deployed in the vertically upright position by virtue of the raised bead (64) contacting a complimentary recess (not shown) formed in the bottom end of the bottom panel (29).

Furthermore, as can be seen by reference to FIGS. 4 through 6, and 8, the hinged panel elements (25), (25') on the bed frame (21) provide a dual function in that when the bed unit (11) is in the stored vertical orientation, the panel elements (25), (25') physically space the bed frame (21) and the mattress (100) from a vertical wall surface, while in the horizontally deployed orientation of the bed unit (11), the panel elements (24), (24') may optionally be deployed as side walls along at least a portion of the mattress, or collapsed to facilitate the ingress and egress of a person onto the mattress (100).

It should also be noted that this invention also contemplates the provision of ventilation slots (67) in the enclosure unit (12) as shown in FIG. 4 to promote air flow to the bed unit (11) so as to prevent a musty smell developing in the mattress (100) in those instances wherein the bed unit is deployed in the stored position for prolonged periods of time.

In addition, in the preferred embodiment of this invention illustrated in the drawings, the height of the mattress (100) is approximately 21" above the floor so that the person sleeping on the mattress is not exposed to dust, drafts or chills.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A wall bed apparatus comprising:

a free standing bed member including a generally open rectangular bed frame having a conventional slat arrangement for supporting a mattress, a bottom panel extending across at least a portion of the bed frame, a pair of pivotable legs associated with a first end of the bed frame and a pair of enlarged arcuate rocker panels associated with a second end of the bed frame; wherein the rocker panels have a generally flat portion that will support the bed frame in a vertically upright stand alone position; and an enclosure unit which comprises; a three sided member wherein two sides of the enclosure member are dimensioned to overlay a portion of the sides of the bed frame.

2. The wall bed apparatus as in claim 1 wherein the said second end of the bed frame is provided with a counterweight for stabilizing the bed frame in an upright position and facilitating the rotation of the bed frame on the rocker panels to deploy the bed frame in a horizontal disposition.

3. The wall bed apparatus as in claim 1 wherein the bed frame has opposed sides and each of the sides is provided with an elongated hinged panel element that extends a substantial distance along the upper portion of each side.

4. The wall bed apparatus as in claim 3 wherein the hinged panel segments are dimensioned to space said mattress from a vertical wall surface in the vertical orientation of the bed frame.

5. The wall bed apparatus as in claim 1 wherein the outer periphery of the rocker panels are provided with a protective covering.

6. The wall bed apparatus as in claim 1 wherein the three sided enclosure member is further provided with a hinged lid.

7. The wall bed apparatus as in claim 6 wherein the three sided enclosure member is also provided with an internal compartment disposed beneath said hinged lid.

8. The wall bed apparatus as in claim 1 wherein the three sided enclosure member is provided with a plurality of ventilation apertures.

9. A wall bed apparatus comprising:

a free standing bed member including a generally open rectangular bed frame having a conventional slat arrangement for supporting a mattress, a bottom panel extending across at least a portion of the bed frame, a pair of pivotable legs associated with a first end of the bed frame and a pair of enlarged arcuate rocker panels associated with a second end of the bed frame; wherein the rocker panels have a generally flat portion that will support the bed frame in a vertically upright stand alone position; and an enclosure member having two sides that are dimensioned to overlay a portion of the sides of the bed frame, and a top portion extending between said two sides.

10. The wall bed apparatus as in claim 9, wherein said top portion comprises a hinged lid.

11. The wall bed apparatus as in claim 10, wherein said enclosure member is further provided with an internal compartment disposed beneath said hinged lid.

12. The wall bed apparatus as in claim 9, wherein, the enclosure member further includes a front portion associated with said two sides.

* * * * *